United States Patent [19]

Fitzwater

[11] Patent Number: 4,968,078

[45] Date of Patent: Nov. 6, 1990

[54] ADJUSTABLE COMPOUND-ACTION CLAMP

[76] Inventor: Edwin Fitzwater, 1370 Bryant St., Rahway, N.J. 07065

[21] Appl. No.: 356,259

[22] Filed: May 24, 1989

[51] Int. Cl.[5] ..... A44B 21/00

[52] U.S. Cl. ..... 294/16; 24/509

[58] Field of Search ..... 294/115, 100, 16, 106; 24/490, 492, 495, 500, 502, 507, 489, 508, 509

[56] References Cited

U.S. PATENT DOCUMENTS

| | | | |
|---|---|---|---|
| 1,350,675 | 8/1920 | Smith | 294/115 |
| 2,357,104 | 8/1944 | Grinnell | 24/507 X |
| 2,493,949 | 1/1950 | Donahue | 294/115 X |
| 2,504,152 | 4/1950 | Riker et al. | 294/115 X |
| 3,328,066 | 6/1967 | Johnson | 294/115 X |
| 3,446,525 | 5/1969 | Jones | 294/115 X |
| 4,175,306 | 11/1979 | Bigelow et al. | 24/507 |

FOREIGN PATENT DOCUMENTS

| | | | |
|---|---|---|---|
| 27159 | 3/1977 | Japan | 294/115 |

*Primary Examiner*—Margaret A. Focarino
*Assistant Examiner*—Dean J. Kramer
*Attorney, Agent, or Firm*—John F. Ohlandt

[57] ABSTRACT

An adjustable compound-action spring clamp for enabling the application of an adjustable force to a workpiece, while insuring that in operation only a slight increase of hand gripping force is required for substantially opening the jaw portions compared with the hand gripping force required initially to separate the jaw portions.

6 Claims, 3 Drawing Sheets

ADJUSTABLE COMPOUND-ACTION CLAMP

BACKGROUND OF THE INVENTION

The present invention relates to a hand clamp, more specifically to one that provides adjustability, by reason of being able to change the compression of a spring, and also provides compound action. By compound action is meant that this clamp utilizes a coiled compression spring which transmits its adjustable force to the clamp arms through connecting, movable links, instead of a torsion spring applying its closing forces directly to the arms.

A variety of hand clamps have been known heretofore as, for example, those described in U.S. Pat. Nos. 2,001,707; design patent 138,285; 2,815,777; and 3,779,108.

The device described in U.S. Pat. No. 2,001,707 is referred to as a hand tool of the plier type having provision for releasably holding the retaining cone-shaped split keepers for the valve spring retainer disks of internal combustion engines or the like. Accordingly, it is a quite specialized tool. However, it does provide the general feature of a spring which is coiled about a pivot pin, and about which the plier handles are pivotable; the spring has extensions that engage with the respective handles so that the plier jaws are urged toward each other into a closed position.

U.S. Pat. No. 2,815,777 discloses a spring actuated miter clamp similar in many respects to the aforesaid U.S. Pat. No. 2,001,707. However, for its own special purposes, it has pivotable jaws mounted on the closing ends of the lever arms or handles.

U.S. Pat. Nos. 3,779,108 and design patent 138,285 also disclose clamps of different configurations including spring members.

A major difficulty that arises in the use of spring clamps and the like, as described in the references cited above, is that although only a moderate force is necessary initially to separate the clamp jaws or jaw portions, a substantially greater force is required to cause the clamp jaws to be opened a substantial distance. For example, an opening of approximately two inches is necessary so that a fairly large workpiece can be grasped or clamped. As a consequence, conventional torsional spring clamps are unsatisfactory for use by persons having limited hand strength. Additionally, if one manages to get the clamp open, the clamping force may be much greater than needed for the job to be done. Further, there is no way to control this force.

Accordingly, a primary object of the present invention is to overcome the aforesaid difficulty and to provide a clamp construction such that, for a given spring adjustment, only a slightly greater force is required to cause the jaws to be spaced apart a greater distance, compared with the force used initially to separate the jaws.

Another object is to enable ready adjustment of the spring force to be applied to a workpiece by the clamp, and to preserve substantial constancy in required gripping force for the two operations noted as the value of the spring force employed is varied. Reference to actual tests performed will make the above object clear.

SUMMARY OF THE INVENTION

The above and other objects and advantages of the present invention are fulfilled by a principal feature of the present invention, which resides in the provision of a means causing a large component of the user's gripping force to be applied to the more compressed spring means involved as that force is increased on the grip portions of the clamping arms. Accordingly, the inherently greater spring compression that results is effectively countered; and the intrinsically high ratio that would normally obtain between the two force values is significantly reduced. In other words, due to this feature, a much slighter increase in gripping force, and hence a much smaller ratio between the two force values, is required.

The aforesaid means for producing the above-noted result takes the form of a linkage means extending at a suitable angle $\theta$ from the spring means which functions to supply the clamping force. This linkage means is coupled to a pair of spaced pivot points on the respective clamp arms. Accordingly, the clamp jaws are in the closed position with a certain applied clamping force as a consequence of a particularly selected compression for the spring means. It is understood, of course, that the spring means acts to bias the clamp levers or arms to produce such closed position for the jaws. The total force applied is the result of the two components on the arms derived from the action of the spring means on the linkage means.

In the particular embodiment to be described, the linkage means takes the form of two individual links, one end of each of the links being connected to a respective one of the aforenoted spaced pivots on the arms, the opposite ends of the links both being connected to a common pivot disposed immediately above the spring means.

It will therefore be understood that in the initial position, that is, when the jaws are closed, the individual links are at a predetermined relatively large angle with respect to the axis of symmetry on which the spring means is disposed. Hence, a relatively small component of the total gripping force applied to the clamp arms is effective against the force of the spring means. Such a small component is, at this stage, all that is required. However, as the arms are rotated about their common pivot point, the angular relationship of the links with the main pivot point changes such that the angle is lessened, whereby a greater component of the gripping force is then applied downwardly on the spring means in the more open position for the jaws. This is totally unlike clamps heretofore known. As emphasized previously, since there is no compound action involved with those known clamps to help the user, a much greater gripping force must be applied as the spring means is further compressed.

Other and further objects, advantages and features of the present invention will be understood by reference to the following specification in conjunction with the annexed drawing, wherein like parts have been given like numbers.

DESCRIPTION OF PREFERRED EMBODIMENT

Figure 2A:
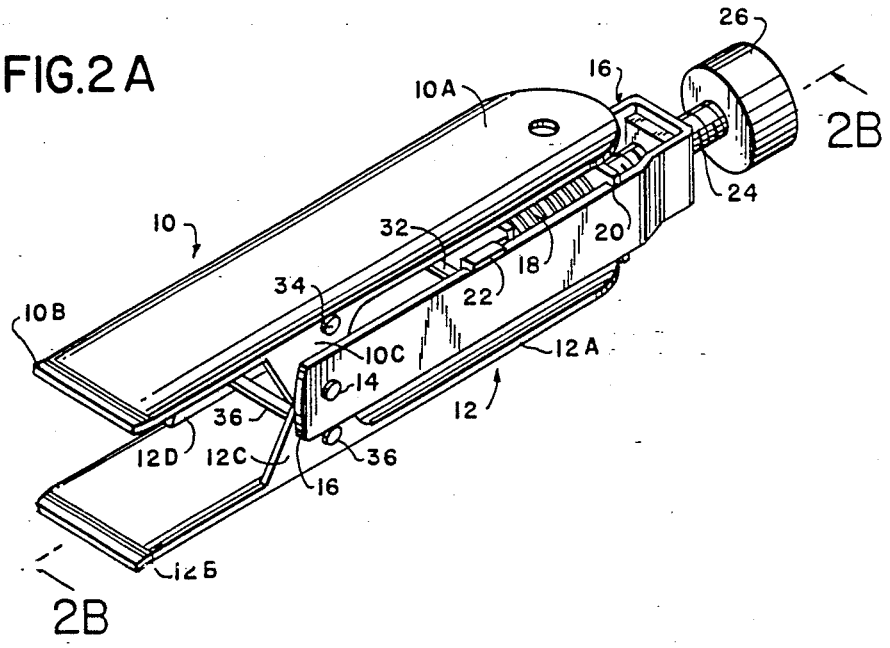
FIG. 2A is another perspective view of the clamp, but here sufficient gripping force has been applied to open the jaws or jaw portions.
Figure 2B:
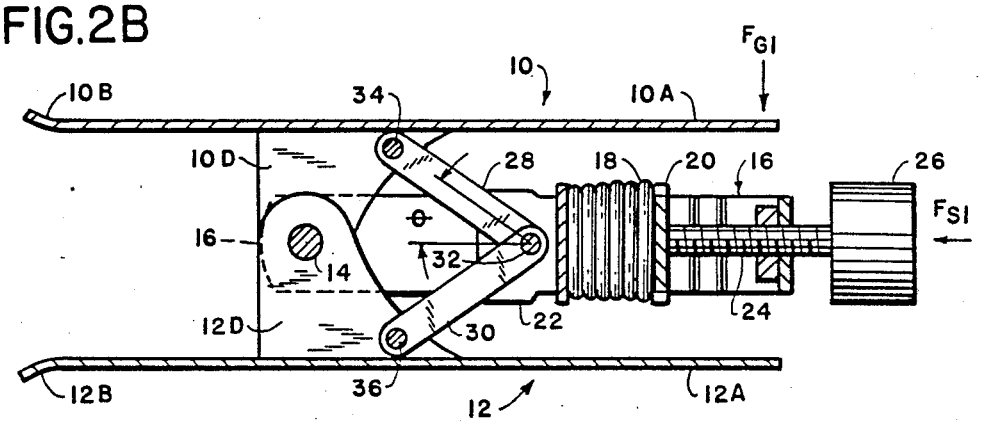
FIG. 2B is a sectional view, taken on the line 2B—2B of FIG. 2A, showing the same clamp in the open position.
Figure 3:
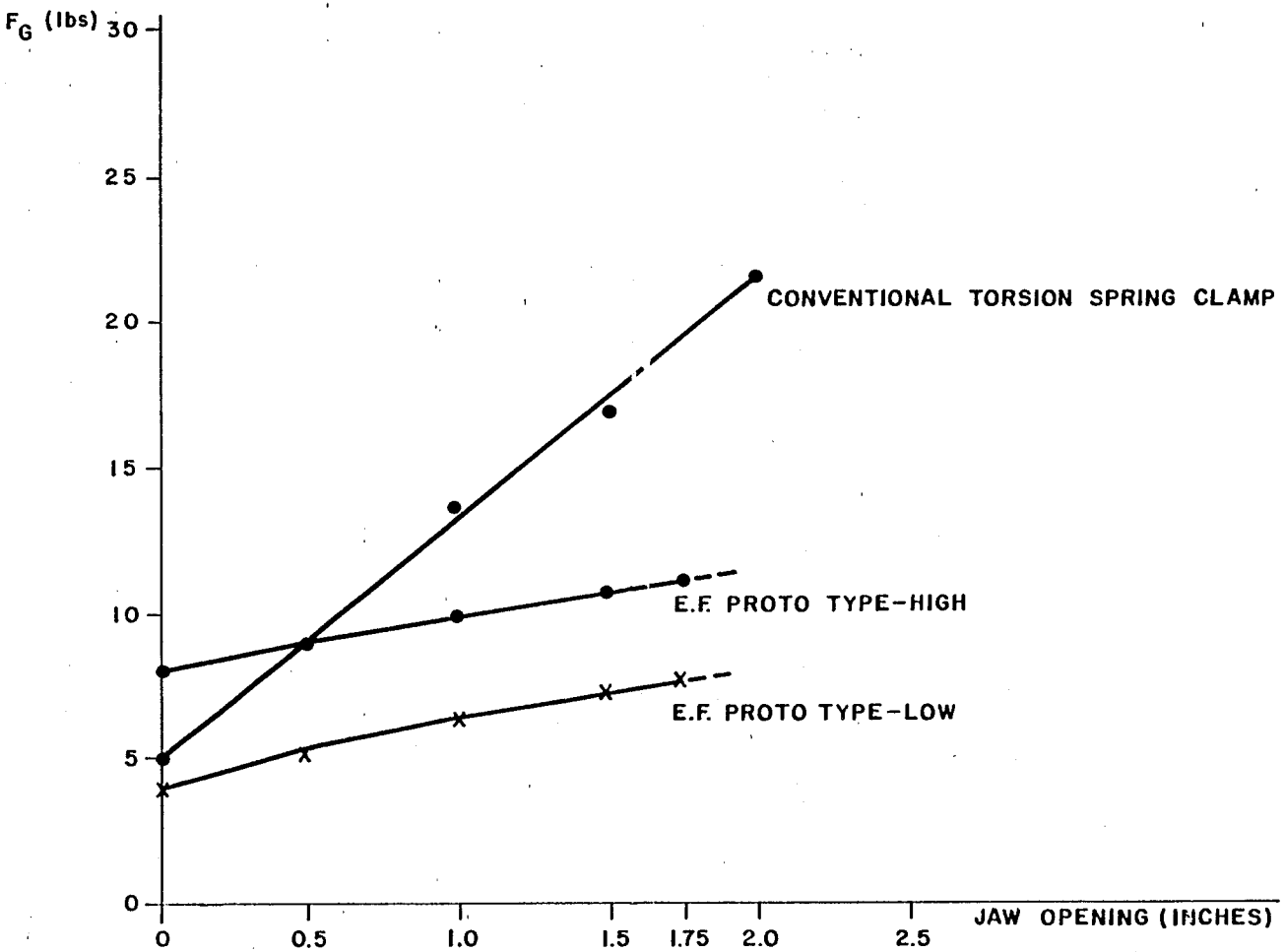
FIG. 3 is a graph depicting results (hand gripping force $F_G$ versus jaw opening) obtained from tests performed on applicant's novel adjustable clamp with two different adjustments of the spring means; and the results obtained from tests performed on a conventional clamp. Both clamps tested were approximately the same size, i.e., about 6 inches in length.

Referring now to the figures of the drawing, a preferred embodiment will be particularly noted in connection with FIGS. 1–3.

This embodiment of the adjustable clamp of the present invention comprises levers or arms 10 and 12 pivotably mounted with respect to each other. Portion 10A is referred to as the grip portion and 10B the jaw portion of arm 10; whereas 12A is the grip portion and 12B the jaw portion of arm 12. An alternate construction could be two separate arm parts pivoted or connected for compound leverage.

To enable pivotability of arms 10 and 12, a main pivot point includes pivot means 14 in the form of a bolt or rivet which extends at one end through complementary overlapping wing-like portions 10C and 12C on one side of the respective arms 10 and 12; and, at its opposite end, through complementary overlapping portions 10D and 12D on the other side of said arms.

Also attached to the pivot means 14 at the main pivot point and held thereby on the axis of symmetry of the clamp is a frame 16. Received within the U-shaped configuration of frame 16 is a compression spring 18 engaged at its rearward end by a plate or guide 20, and at its forward end by a U-shaped mechanism 22 for purposes to be explained. The spring 18 is adjustably compressed between the rearward plate 20 and the forward mechanism 22 by adjusting a threaded screw 24 which bears against plate 20, such screw having a knob 26 at its rearward end.

The forward mechanism 22 is restrained in its ability to move by reason of the presence of spring links 28 and 30, which function to resist movement of the spring 18 and effectively, when the spring is variably compressed, for applying variable force to the arms 10 and 12 such that the jaw portions 10B and 12B are held shut, resulting in a variable clamping force ($F_J$).

It will be appreciated that the rearward ends of both of the spring links 28 and 30 are connected to a common means in the form of a bolt or pin 32 and that further means 34 and 36, in the form of bolts or pins, provide for attachment of respective forward ends of links 28 and 30.

Figure 1A:
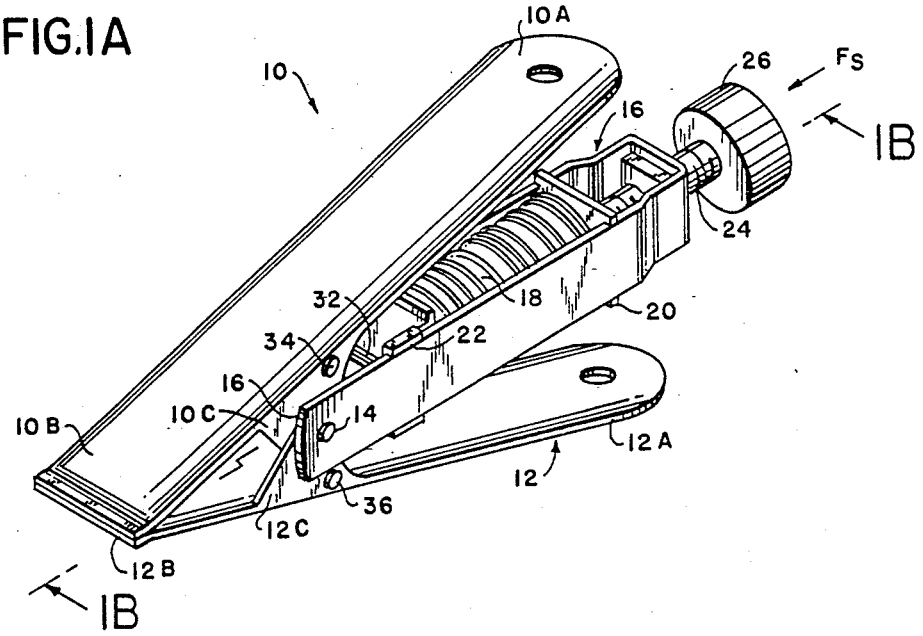
FIG. 1A is a perspective view of the clamp of the present invention in which the arms or levers are in such position that the jaw portions are closed or abutting, it being understood that a first predetermined adjustment, hence compression state, for the spring means is provided.
Figure 1B:
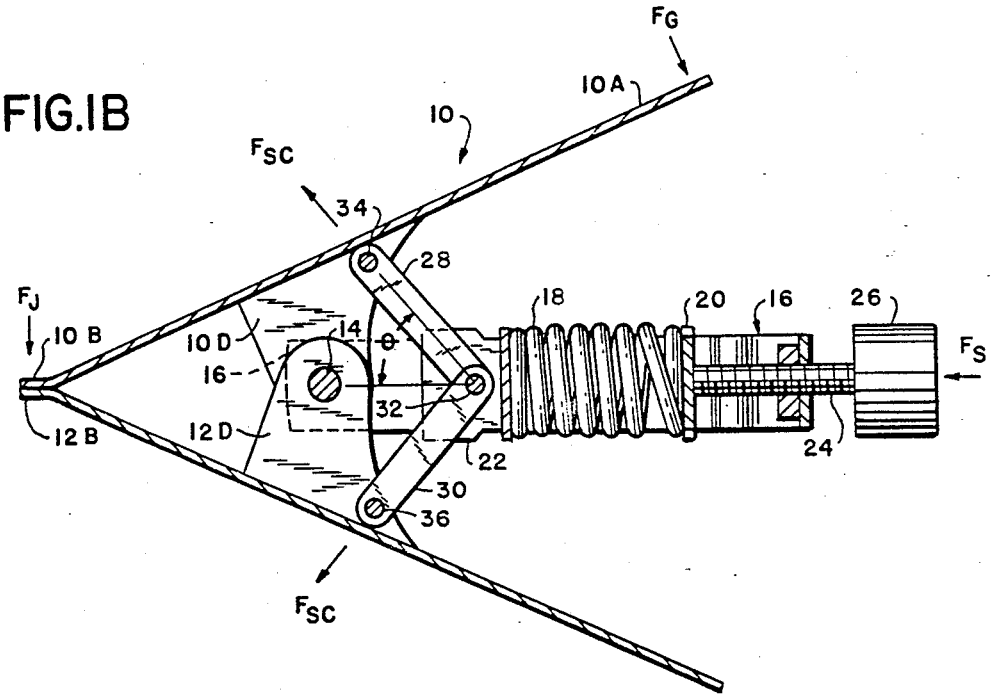
FIG. 1B is a sectional view, taken on the line 1B—1B of FIG. 1A, of that clamp embodiment.

Let it be assumed that in FIG. 1A, the clamp of the present invention has had the spring 18 set to a low compression value (see the lower curve in FIG. 3). This corresponds to a spring force ($F_S$) of approximately 12 pounds or so, this force resolving itself as seen in FIG. 1B to two component forces $F_{SC}$ along the respective links 28 and 30. Such spring force of 12 pounds translates into a hand gripping force $F_G$ of approximately 4 pounds (see FIG. 3), which must be applied just to open the jaws. Likewise, referring now to FIGS. 2A and 2B, when the jaws are opened, as depicted, approximately two inches, the spring has now been compressed back due to the application by hand of a higher value of grip force $F_G$ such that the spring now exerts a new force ($F_{S1}$) of approximately 18 pounds, this being the selected spring rate for this example.

It will be understood that with change in all the angles of the parts and, in particular, the fact that the angular relationship $\theta$ between the links and the axis of symmetry, as seen in FIGS. 1B and 2B, has changed significantly in value between these two positions of the clamp, the new force required at the grip ($F_G$) is approximately 8 pounds, with proportionately higher jaw clamping force.

Accordingly, it will be understood, referring now to the lowermost curve in FIG. 3, that the change in $F_G$ between the open and closed positions for the clamp is approximately 4 pounds. In sharp contrast to this is the curve denominated "torsional spring" in which it is seen that the full change of the grip force required from the closed to open position is from 5 pounds to approximately 22 pounds, or an increase of 17 pounds for this conventional torsional spring clamp. Such clamp can be appreciated by referring to previously cited U.S. Pat. No. 2,815,777.

It has been noted previously that, in order to increase the jaw clamping force $F_J$, such can be accomplished by advancing the knob 26 and, of course, as the clamping force increases its value, the grip force value ($F_G$) will he greater. As will be understood, this adjustment can be calibrated by marking on the outside of the spring frame 16 the positions of the adjusting screw guide or plate 20. The upper curve in FIG. 3, marked "High", graphically depicts the relationship between $F_G$ and jaw opening when the clamping force $F_J$ is changed to such high value by adjustment of knob 26.

As will be understood by those skilled in the art, if one wishes to verify the calculation applied here, it is simply done from a basic understanding of force resolutions. All of the moments are taken about the main pivot point or means 14. It will be appreciated that for the purposes of tests and explanations, the values $F_G$ or $F_{Grip}$ are shown at the ends of the arms, and called "grip force", although one does not grip the clamp at the very end. Also related to this, it is understood that clamps of this type are used by the jaw clamping forces, not the grip forces.

For a clamp of this size, $F_{Jaw}$ is directly proportional to $F_{Grip}$ by the ratio of the lengths to the main pivot, or $$\frac{3.5 \text{ inches}}{2.5 \text{ inches}} = 1.4.$$

The jaw clamp force is about 1.4 times the grip force.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

I claim:

1. An adjustable compound-action spring clamp having a longitudinal axis of symmetry comprising:

a first or main pivot point on said longitudinal axis;

a pair of pivotable, straight clamping arms, each arm having a jaw portion and a grip portion, said arms being pivoted about said main pivot point responsive to said grip portions being gripped, the grip portions diverging substantially rearwardly of said main pivot point;

complementary wing-like portions on each side of the respective arms, said portions extending inwardly so as to overlap slightly beyond said main pivot point, said main pivot point extending through said portions;

a spring means compressed along said longitudinal axis of symmetry for biasing said pair of pivotable arms such that the jaw portions thereof normally are in a closed position, but which jaw portions can be opened if sufficient force is applied oppositely inwardly to said grip portions of said arms;

linkage means for coupling said compressed spring means to said arms, said linkage means normally extending at a predetermined angle to the axis of symmetry;

second and third pivot points on said respective arms;

one end of said linkage means being connected to said second and third pivot points, said pivot points being substantially equidistant from said main pivot point, the other end of said linkage means being connected to said spring means.

2. A device as defined in claim 1, in which said spring means is held in a U-shaped frame having a plate or guide at its rearward end; and a means at its forward end for coupling of said linkage means, whereby, when said spring means is compressed, the force of said spring means is transmitted through said means at the forward end of the frame, and thence through said linkage means to said arms.

3. A device as defined in claim 1, in which said linkage means takes the form of two individual links, one end of each of the links being connected to a respective one of said second and third pivot points on the arms, the opposite ends of the links both being connected to a common pivot point coupled to, and disposed forwardly of, the spring means.

4. A device as defined in claim 3, in which the individual links are at a predetermined, relatively large angle with respect to the axis of symmetry on which the spring means is disposed, whereby a relatively small component of the total gripping force applied to the clamp arms is effective to compress the spring means.

5. Apparatus as defined in claim 4, in which said arms are operable about the main pivot point when gripping force is applied, such that the angular relationship of said links with the main pivot point is altered, whereby a greater component of the gripping force is then applied rearwardly on the spring means in the more open position for the jaw portions.

6. A device as defined in claim 1, further comprising means for adjusting the spring compression such that the clamping force on the jaw portions can be increased.

* * * * *